US005142892A

United States Patent [19]

Noé et al.

[11] Patent Number: 5,142,892

[45] Date of Patent: Sep. 1, 1992

[54] ARRANGEMENT FOR ADJUSTING THE ROLL GAP IN ROLLING MILL STANDS, PARTICULARLY IN STRIP ROLLING MILL STANDS FOR HOT OR COLD ROLLING

[75] Inventors: Oskar Noé, Mülheim; Willi Dötsch, Oberhausen, both of Fed. Rep. of Germany

[73] Assignee: BWG Bergwerk-und Walzwerk-Maschinenbau GmbH, Duisburg, Fed. Rep. of Germany

[21] Appl. No.: 676,952

[22] Filed: Mar. 28, 1991

[30] Foreign Application Priority Data

Apr. 3, 1990 [DE] Fed. Rep. of Germany ..... 4010662

[51] Int. Cl.[5] ..... B21B 31/32

[52] U.S. Cl. ..... 72/20; 72/245

[58] Field of Search ..... 72/20, 241.6, 241.8, 72/245

[56] References Cited

U.S. PATENT DOCUMENTS

| | | | |
|---|---|---|---|
| 3,024,679 | 3/1962 | Fox | 72/245 |
| 3,906,767 | 9/1975 | Tanaka et al. | 72/245 |
| 4,086,797 | 5/1978 | Vydrin et al. | 72/245 |
| 4,087,999 | 5/1978 | Vydrin et al. | 72/245 |

*Primary Examiner*—Lowell A. Larson
*Assistant Examiner*—Thomas C. Schoeffler
*Attorney, Agent, or Firm*—Anderson Kill Olick

[57] ABSTRACT

An adjusting arrangement for the roll gap or rolling force in rolling mill stands. The arrangement includes two hydraulic adjusting cylinders which act from both sides on a work roll to be adjusted. The adjusting cylinders each have two or more piston surfaces to which pressure medium can be applied independently of each other, either individually, in any combination, or to all piston surfaces. This makes it possible to adjust the rolling force within the respective rolling force range in such a way that percentage variations of the rolling force are minimized and, consequently, different roughnesses and differences in wall thicknesses can be almost completely eliminated.

4 Claims, 3 Drawing Sheets

ARRANGEMENT FOR ADJUSTING THE ROLL GAP IN ROLLING MILL STANDS, PARTICULARLY IN STRIP ROLLING MILL STANDS FOR HOT OR COLD ROLLING

BACKGROUND OF THE INVENTION

1. Field of the Invention

The present invention relates to an arrangement for adjusting the roll gap or the rolling force in rolling mill stands, particularly in strip rolling mill stands for hot or cold rolling. The arrangement includes at least two hydraulic adjusting cylinders which act through chucks, and possibly through intermediately mounted back-up rolls, from both sides on a work roll to be adjusted.

2. Description of the Related Art

In rolling mill stands for rolling steel and non-ferrous metals, it is known in the art to adjust the work rolls, i.e., usually the upper roll and the lower roll, by means of hydraulic adjusting cylinders. The adjustment results in a change of the width of the roll gap and in a change of the rolling force. Particularly in strip rolling mill stands for hot or cold rolling, hydraulic adjusting cylinders having almost completely replaced the conventional adjustment by means of threaded spindles.

In cold rolling mill stands, the rolling forces range from several hundred tons to several thousand tons. For example, in skin pass rolling mill stands or temper pass rolling mill stands, the rolling forces range from about 100 tons to about 1500 tons, depending on the dimensions of the strip and the strength of the material. The rolling forces of this magnitude must be transmitted from always two hydraulic adjusting cylinders through the chocks to the work roll. This means that the work rolls do not only have to be adjusted but the adjustment of the roll gap must be maintained in this position. The hydraulic adjusting cylinders are quickly adjusted by means of a low liquid pressure, while a high pressure pump produces the rolling forces.

The pressure control is effected by means of hydraulic power-assisted valves. Such power-assisted valves operate with a maximum pressure of about 250 bar and with a controlling accuracy of about ± 1.0 bar. The controlling deviations are almost constant over the entire pressure range. The controlling range of the rolling force for a rolling mill stand is approximately 1 : 15 to 1 : 20. This means for a rolling mill stand with a rolling force range of, for example, 100 tons to 1500 tons and a maximum pressure of 250 bar, a controlling deviation from the rolling force of ± 6 tons. In the case of a 100 ton nominal rolling force, this means a controlling deviation of ± 6 tons = 12 tons = 12%, while in the case of a nominal rolling force of 1500 tons this means only ± 6 tons = 12 tons = 0.8%. Accordingly, the controlling deviations are significantly greater in the lower rolling force range than in the upper rolling force range. When rolling metal strip, this leads to corresponding deviations of the thickness of the strip over the length of the strip. In temper pass rolling mill stands, in which in addition to a slight reduction in thickness primarily a certain surface conditioning, for example, a predetermined roughness is to be obtained, such rolling force variations lead to different roughness and differences in the strip thickness over the length of the strip at spacings which correspond to the controlling frequency of the power-assisted valves. Such deviations lead to failures during the subsequent processing of the metal strip, for example, during deep drawing, coating or the like. If such rolling mill stands are used in processing trains such as continuous strip pickling trains, annealing trains, coating trains, or the like, it is necessary to use several rolling mill stands with different rolling force ranges.

SUMMARY OF THE INVENTION

Therefore, it is the object of the present invention to provide an adjusting arrangement for adjusting the roll gap or the rolling force in rolling mill stands, particularly in strip rolling mill stands for hot or cold rolling, of the above-described type, in which the percentage of the rolling force deviations during rolling force control can be kept extremely small over the entire rolling force range.

In accordance with the present invention, this object is met in an adjusting arrangement of the above-described type by providing the adjusting cylinders each with two or more piston surfaces, wherein pressure medium can be applied to the piston surfaces individually, to any combination of piston surfaces or to all piston surfaces.

The invention starts from the finding that admitting the pressure medium to the piston surfaces individually, to a combination of piston surfaces or to all piston surfaces makes it possible to select a minimum percentage deviation within the overlapping rolling force ranges and, consequently, to minimize the percentage of the variations of the rolling force, if each adjusting cylinder has two or more piston surfaces.

The example described below of a rolling mill stand with a maximum rolling force of 1500 tons and a minimum rolling force of 100 tons and with two adjusting cylinders with piston surfaces to which pressure medium can be admitted independently of each other makes clear that the maximum controlling deviation in a pressure range of between 50 bar and 250 bar is only at most 2%, as compared to 12% in the past. The piston surfaces A1 and A2 to which pressure medium can be applied either individually or together results in the values listed in the following table:

| Piston surface $cm^2$ | Pressure bar min. 50 bar | Rolling force $F_w$ t | $\Delta F_w$ t | Controlling deviation % |
|---|---|---|---|---|
| $A_2 + A_1 = 2 \times 3000$ | 250 ± 1 | 300–1500 | ±6 | ±2.0/±0.4 |
| $A_2 = 2 \times 2000$ | 250 ± 1 | 200–1000 | ±4 | ±2.0/±0.4 |
| $A_1 = 2 \times 1000$ | 250 ± 1 | 100–500 | ±2 | ±2.0/±0.4 |

The present invention realizes in a surprisingly simple manner an adjusting arrangement for the work rolls of rolling mill stands which minimizes the controlling variations, so that thickness deviations over the length of hot-rolled or cold-rolled strips are substantially reduced. Consequently, when used in temper pass rolling mill stands, the desired roughness is practically achieved, so that failures in the subsequent treatment of the strip, such as, deep drawing, coating, or the like are extremely low. Particularly when used in continuous strip pickling trains, annealing trains, coating trains, or the like, it is no longer necessary to use several rolling mill stands with different rolling force ranges.

In accordance with an important feature of the present invention, the adjusting cylinders each include a cup-shaped piston which is guided in a cylinder housing on a cylinder shaft and in a cylinder collar, wherein pressure medium can be applied individually or together to a central piston surface formed in the inner bottom of the cup-shaped piston and to the annular piston surface formed by the rim of the cup-shaped piston.

Pressure medium may be applied alternatingly to both sides of the annular piston surfaces, so that it is possible in this manner simultaneously to facilitate a return of the piston.

Pressure medium can be applied to the piston surfaces by means of a high-pressure control pump and a control pump for quick adjustment with the intermediate arrangement of at least one power-assisted valve an multiple-way valves.

However, it is preferred to provide a power-assisted valve for each adjusting cylinder and a multiple-way valve for each piston surface. Separate power-assisted valves are recommended when it is desired to adjust the work rolls on the one side or the other side independently of each other and, consequently, to vary the roll gap through the width of the gap.

It is also within the scope of the invention when the piston surfaces of individual adjusting cylinders are the piston surfaces to which pressure medium is applied either individually, in any combination or to all piston surfaces together.

The various features of novelty which characterize the invention are pointed out with particularly in the claims annexed to and forming a part of this disclosure. For a better understanding of the invention, its operating advantages attained by its use, reference should be had to the drawing and descriptive matter in which there are illustrated and described preferred embodiments of the invention.

DESCRIPTION OF THE PREFERRED EMBODIMENT

Figure 1:
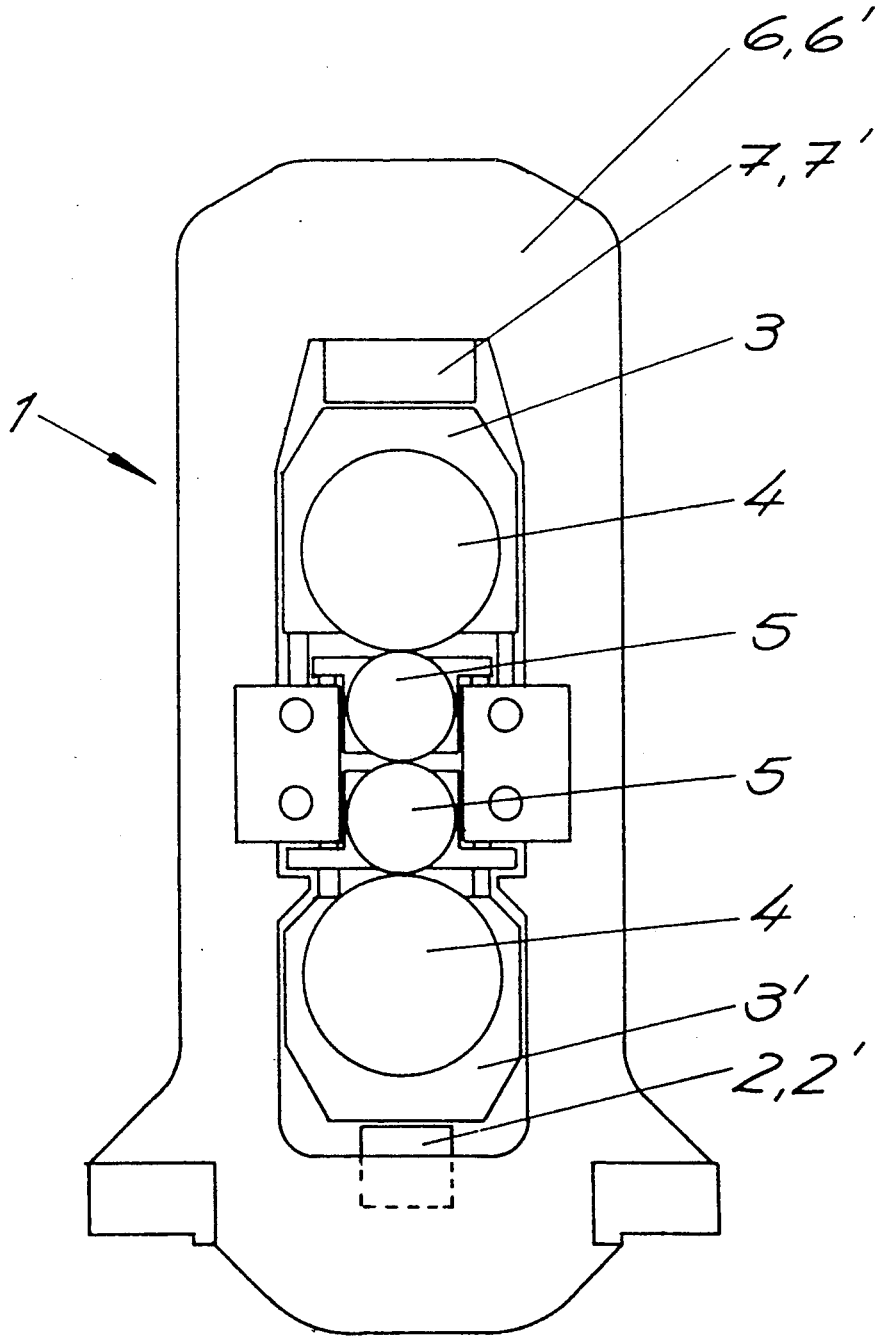
FIG. 1 is a four-high rolling mill stand with an adjusting arrangement according to the present invention.
Figure 2:
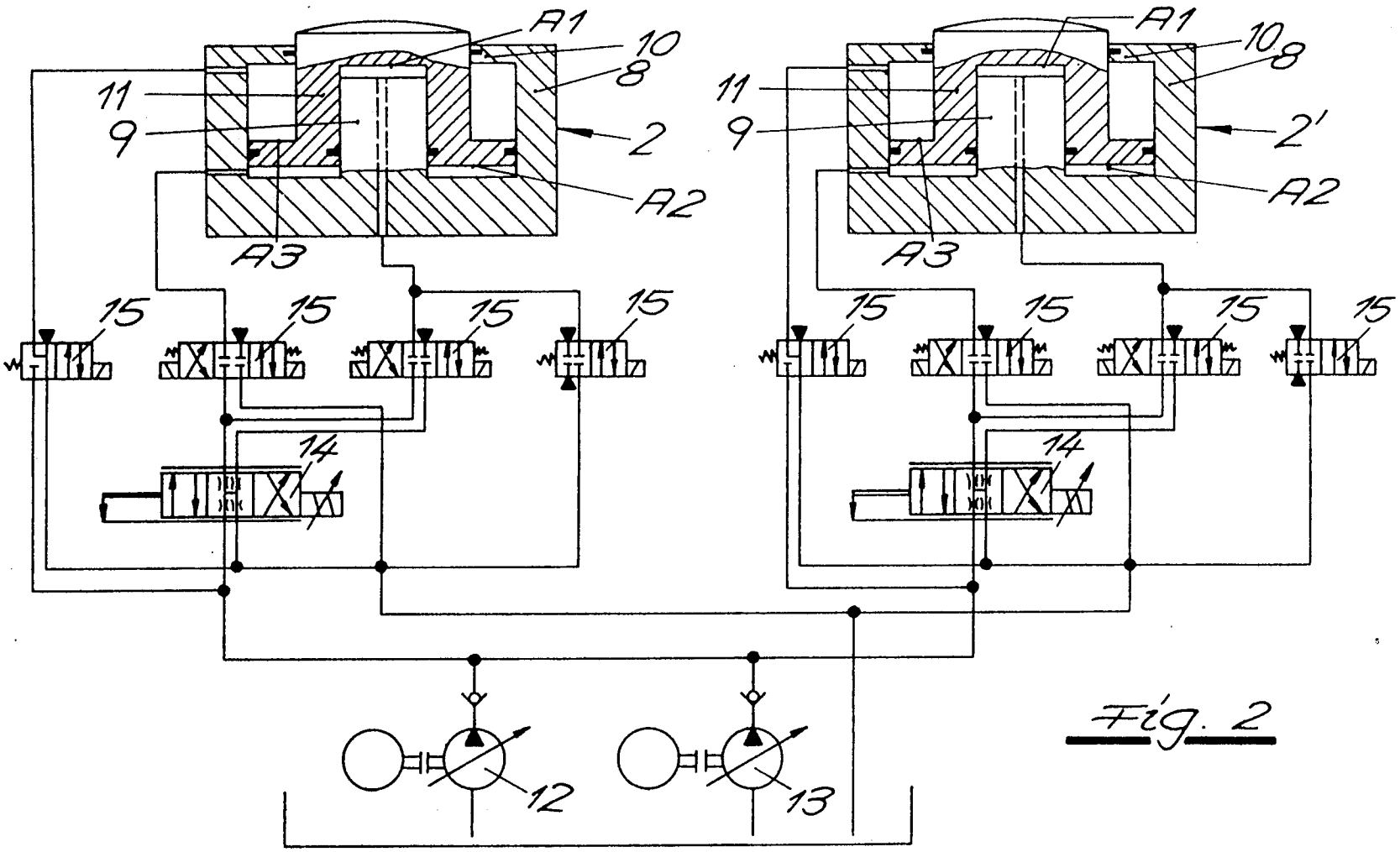
FIG. 2 is a schematic illustration of the adjusting arrangement according to the present invention with two adjusting cylinders.

The figures of the drawing show an arrangement according to the present invention for adjusting the roll spacing or roll gap in rolling mill stands 1, particularly in strip rolling mill stands for hot or cold rolling. The arrangement includes two hydraulic adjusting cylinders 2, 2' which act through chocks 3, 3' and an intermediately arranged back-up roll 4 from both sides on a work roll 5 to be adjusted. In the illustrated embodiment, the work roll 5 is a lower roll. The rolling force of the adjusting cylinders 2, 2' is supported by pressure plates 7, 7' through roll housings 6, 6'.

The adjusting cylinders 2, 2' each have two piston surfaces A1, A2 to which pressure medium can be admitted independently of each other. In other words, pressure medium can be admitted to each piston surface individually or to both piston surfaces. The adjusting cylinders 2, 2' each have a cup-shaped piston 11 which is guided in a cylinder housing 8 on a cylinder shaft 9 and in a cylinder collar 10. Pressure medium can be applied individually or together to the central piston surface Al formed in the inner bottom of the cup-shaped piston 11 and to the annular piston surface A2 formed by the rim of the cup-shaped piston 11. Pressure medium can be applied alternatingly to both sides of the piston surfaces A1, A2 in order to facilitate a return of the cup-shaped piston 11.

The pressure medium is applied to the piston surfaces A1, A2 by means of a high-pressure control pump 12 and a control pump 13 for quick adjustment with the intermediate arrangement of power-assisted valves 14 and multiple-way valves 15. The high-pressure control pump 12 causes the pressure medium or the pressure liquid to act through the power-assisted valves 14 and the multiple-way valves 15 on the piston surfaces A1, A2. The control pump 13 for quick adjustment, which operates with a greater flow and a lower pressure, causes the rolls to be raised until they contact the pressure plates 7, 7'. Balancing cylinders, not shown, are used to maintain contact of the back-up rolls 4 and work rolls 5.

The roll gap can also be preadjusted with the power-assisted valve 14 through roll gap measuring units.

The hydraulic adjusting arrangement according to the present invention can be used in all types of known rolling mill stands. The adjusting cylinders 2, 2' can be arranged in the housing either at the top or the bottom.

Figure 3:
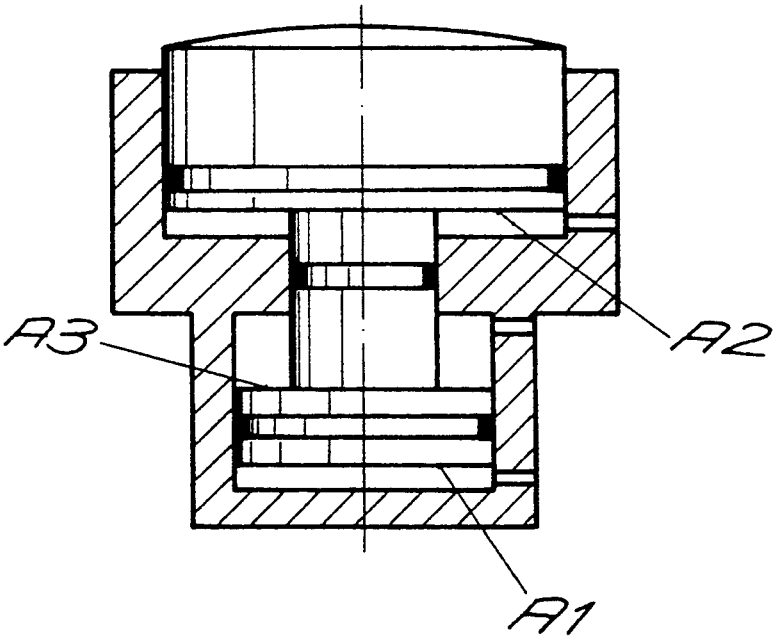
FIG. 3 is a sectional view of another embodiment of the present invention.

Other types of cylinder arrangements are also conceivable, as illustrated in FIG. 3.

While specific embodiments of the invention have been shown and described in detail to illustrate the inventive principles, it will be understood that the invention may be embodied otherwise without departing from such principles.

We claim:

1. In an arrangement for adjusting a roll gap in a rolling mill stand for hot or cold rolling, the arrangement including at least two hydraulic adjusting cylinders which act through chocks from both sides on a work roll to be adjusted, each adjusting cylinder having two or more piston surfaces, and including means for applying pressure medium to one of the piston surfaces individually, to a combination of the piston surfaces and to all of the piston surfaces, the improvement comprising each adjusting cylinder including a cup-shaped piston guided in a cylinder housing on a cylinder shaft and in a cylinder collar, wherein pressure medium can be applied to one of or both of a central piston surface formed in an inner bottom of the cup-shaped piston and an annular piston surface formed by a rim of the cup-shaped piston, further comprising means for alternatingly applying pressure medium to both sides of the annular piston surfaces.

2. The arrangement according to claim 1, comprising back-up rolls mounted between the adjusting cylinders and the work roll.

3. The arrangement according to claim 1, comprising a high-pressure control pump and a control pump for quick adjustment for admitting pressure medium to the piston surfaces, wherein at least one power-assisted valve and multiple-way valves are connected between the piston surfaces and the control pumps.

4. The arrangement according to claim 3, wherein a power-assisted valve is provided for each adjusting cylinder and a multiple-way valve is provided for each piston surface.

* * * * *